United States Patent [19]

Dennis

[11] Patent Number: 4,814,957

[45] Date of Patent: Mar. 21, 1989

[54] SUPERLIGHT

[76] Inventor: Raymond L. Dennis, 16 East Terrace, Cleve, Australia, 5640

[21] Appl. No.: 58,985

[22] Filed: Jun. 8, 1987

[51] Int. Cl.[4] ..... F21L 7/00; F41G 1/34

[52] U.S. Cl. ..... 362/187; 362/110; 362/207; 362/294; 362/296

[58] Field of Search ..... 362/110, 207, 187, 294, 362/296, 376, 437, 439

[56] References Cited

U.S. PATENT DOCUMENTS

| | | | |
|---|---|---|---|
| 1,433,570 | 10/1922 | Stimson | 362/187 |
| 1,561,757 | 11/1925 | Turner | 362/207 |
| 2,128,526 | 8/1938 | Eslick | 362/110 X |
| 2,339,356 | 1/1944 | Sachs | 362/187 |
| 4,286,311 | 8/1981 | Maglica | 362/187 X |
| 4,310,874 | 1/1982 | Spiteri | 362/376 X |
| 4,502,103 | 2/1985 | Collins | 362/294 X |
| 4,535,397 | 8/1985 | May | 362/376 X |
| 4,707,772 | 11/1987 | Jimenez et al. | 362/110 |

FOREIGN PATENT DOCUMENTS

| | | | |
|---|---|---|---|
| 420780 | 4/1934 | United Kingdom | 362/187 |

*Primary Examiner*—Tony M. Argenbright
*Assistant Examiner*—Eric R. Carlberg
*Attorney, Agent, or Firm*—Head & Johnson

[57] ABSTRACT

A spotlight with adjustable focusing that can be held in a fixed position. The reflector has a hub which screws on over the bulb holder which is supported by the light handle. The outer side of the hub has alternating ridges and valleys. A detent is attached to the handle and fits into any valley which might be selected to hold the light in a fixed focusing position. The light can be secured to adjustable rifle telescope studs.

4 Claims, 2 Drawing Sheets

SUPERLIGHT

DISCLOSURE STATEMENT

A preliminary patentability search revealed the following patents:

| | |
|---|---|
| 1,392,165 | 4,388,674 |
| 1,441,884 | 4,398,238 |
| 1,621,955 | 4,429,351 |
| 1,932,102 | 4,527,223 |
| | 4,577,263 |
| | 4,286,311 |

These patents cover various electric lights or flashlights which include a reflector which is attached onto the body of a light as a means of attaching the reflector to the light and at the same time functioning to focus the light.

BACKGROUND OF THE INVENTION

1. Field of the Invention

The present invention relates primarily to flashlights or lights powered by batteries.

2. Setting

Flashlights of various sizes and shapes are well known in the art. In particular certain of such known flashlights utilize two or more dry cell batteries, carried in a series usually in a cylindrical tube serving as a handle for the flashlight as a source of electrical energy. Typically an electrical circuit is established from one electrode of the battery through a conductor to a switch, then through a conductor to one electrode of the lamp bulb or globe. After passing through the filament of the lamp bulb the electrical circuit emerges through a second electrode of the lamp bulb and electrical contact with the conductor which in turn is in electrical contact with the flashlight housing. The power source for such flashlights can vary from typical dry cell batteries to plug-ins for cigarette lighters in automobiles.

Focusing features are provided on some available flashlights. However, retaining of the flashlight in a selected focusing position is dependent primarily on friction of the threads on one member which is fixed in relation to the light bulb and threads which are in a fixed position with respect to the lens. If the use is reasonably active, it is frequently not possible to retain the desired focusing of the light.

SUMMARY OF THE INVENTION

This Superlight light is an advanced spotlight which provides a focus mechanism which allows precise adjustment and fixing of the beam to various concentration patterns as desired. The reflector is rotatable about threads which are supported from a body or holder which supports the globe or bulb. The base of the reflector is provided with a hub which has threads on the inside which mate with threads on the bulb holder so that as the reflector is rotated it will put the bulb in a different position relative to the reflector. Thus, a selected focusing may be obtained. Special detent means are provided to hold the bulb and reflector in a fixed relationship to maintain this special focusing. The outside of the reflector hub is provided with longitudinal grooves and ridges which are parallel to the axis of the hub. This detent means generally may include a leaf spring which is attached at one end to the bulb holder or the light handle and the other end extends over the longitudinal ridges. The detent can be a leaf spring which has a semi-sphere-like shaped engaging element on the outer end which fits into the valleys or grooves between the ridges. When the detent is engaged it takes considerable force to rotate the reflector unless the leaf spring is raised. Thus, the reflector stays in a fixed position with respect to the globe and the selected focusing is fixed or maintained until it is again intentionally changed.

The Superlight light is also provided with air cooling fins, a pistol grip handle and means for mounting on rifle scopes and the like.

It is therefore an object of this invention to provide a Superlight light operated from batteries and which has adjustable focusing to a select position and means to maintain such selected focusing.

Figure 1:
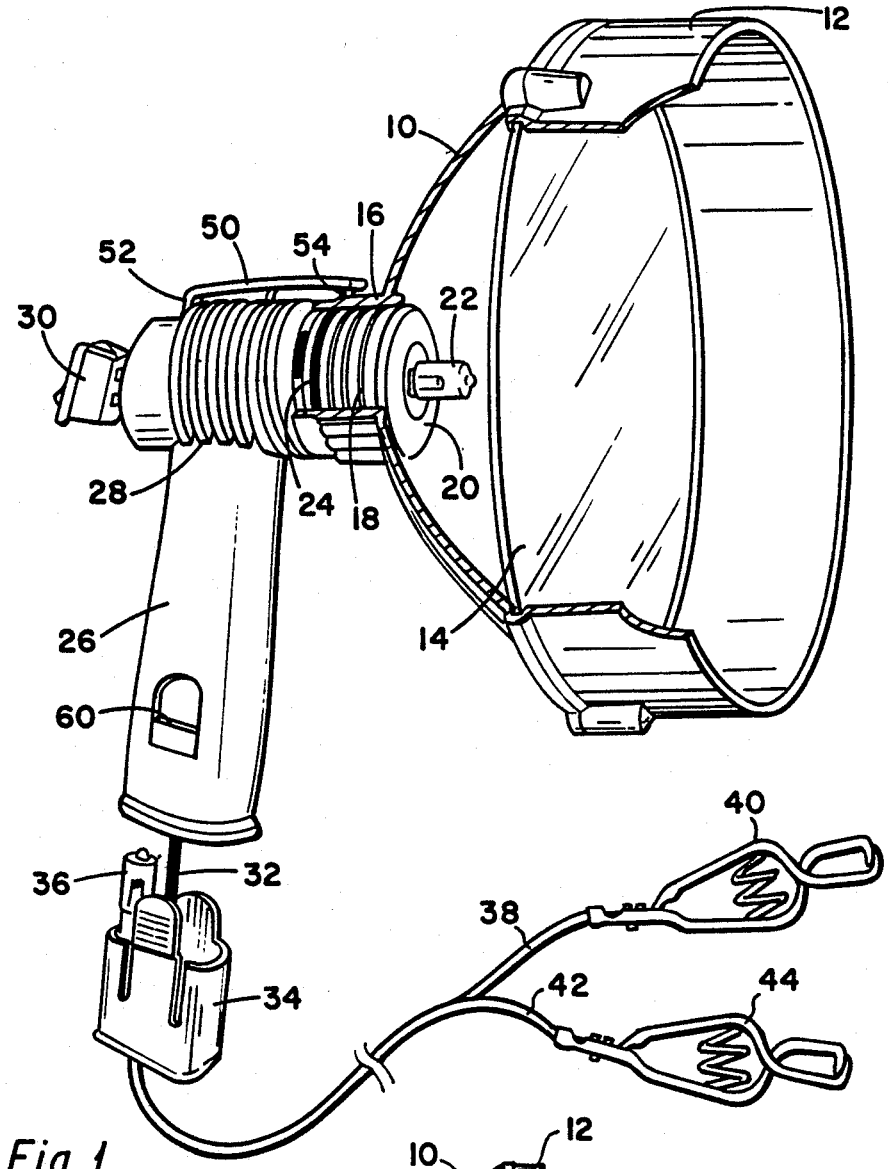
FIG. 1 is an isometric view partly cut away showing the Superlight light of my invention.

Attention will now be directed toward that part of the embodiment which permits the maintaining of the desired focusing. This includes a detent which includes for example a leaf spring 50 secured at end 52 to handle 26. The other end of the leaf spring 50 contains an engaging element 54 which may be in the shape of a hemisphere. The outer surface of hub 16 is provided with alternating ridges 56 and valleys or recesses 58. These ridges and valleys are essentially directed parallel to the axis of the hub. The engaging element 54 may be lifted from the valley in which it is in and the reflector rotated to the desired focusing position to obtain a selected focusing of the light. At this time the engagement element 54 is permitted to enter the correct recess 58. It thus holds the reflector in the proper selected rotational position to obtain the desired focusing. The engagement element 54 when in this position resists any turning of the reflector. To rotate the reflector it is normally the preferred operation to lift the engagement element 54 out of its valley or groove and then rotate the reflector.

If desired, the handle 26, which is preferably hollow can also be vented at 60 to aid in cooling the spotlight.

Figure 5:
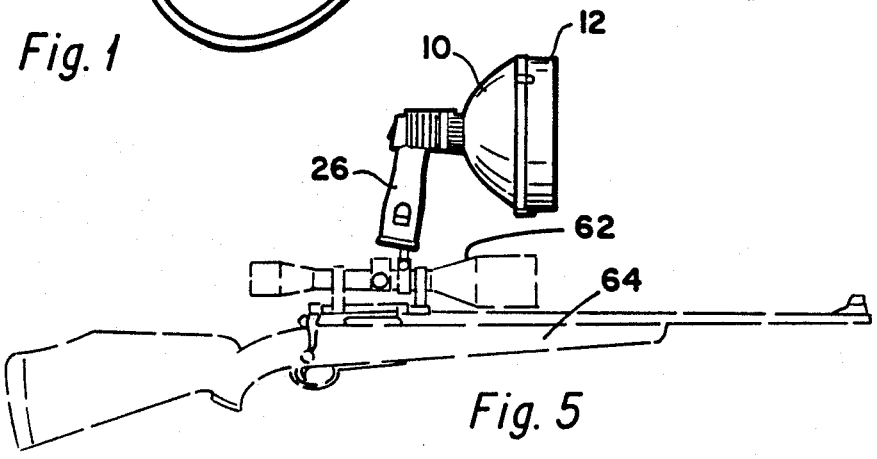
FIG. 5 shows my Superlight light mounted on the scope of a rifle. DETAILED DESCRIPTION Attention is first directed to FIG. 1 which shows the Superlight spotlight of my invention. Shown thereon is a parabolic reflector 10 which supports a lens hood 12. A lens 14 is mounted in a groove in hood 12. The apex end of reflector 10 is provided with a hub 16 which has internal threads which mate with the focusing threads 18 on cylindrical member or handle termination 20. The inside thereof holds globe holder which in turn supports a globe or bulb 22. The globe holder is in fact a separate part held in place by a self fastening clip. A seal, such as O-ring 24 is provided which provides water and dust proofing. The globe holder 20 is supported by handle 26. Handle 26 has cooling fins 28 at its upper end to dissipate some of the generated heat. A switch 30 is provided on the handle. A twin cable flex 32 extends through the clip end insert 34 which fits into the lower end of handle 26. A spare bulb 36 fits into clip 34. The twin cable includes a first cable 38 having clip 40 and a second cable 42 having clip 44. Clips 40 and 44 are typically those that can be engaged on the terminal posts of a battery. The lens hood or flange 12 functions as a lens protector and shields against scattered light. The switch 30 functions in the normal manner to complete the circuit from one clip 40 through the globe 22 back to the other clip.
Figure 2:
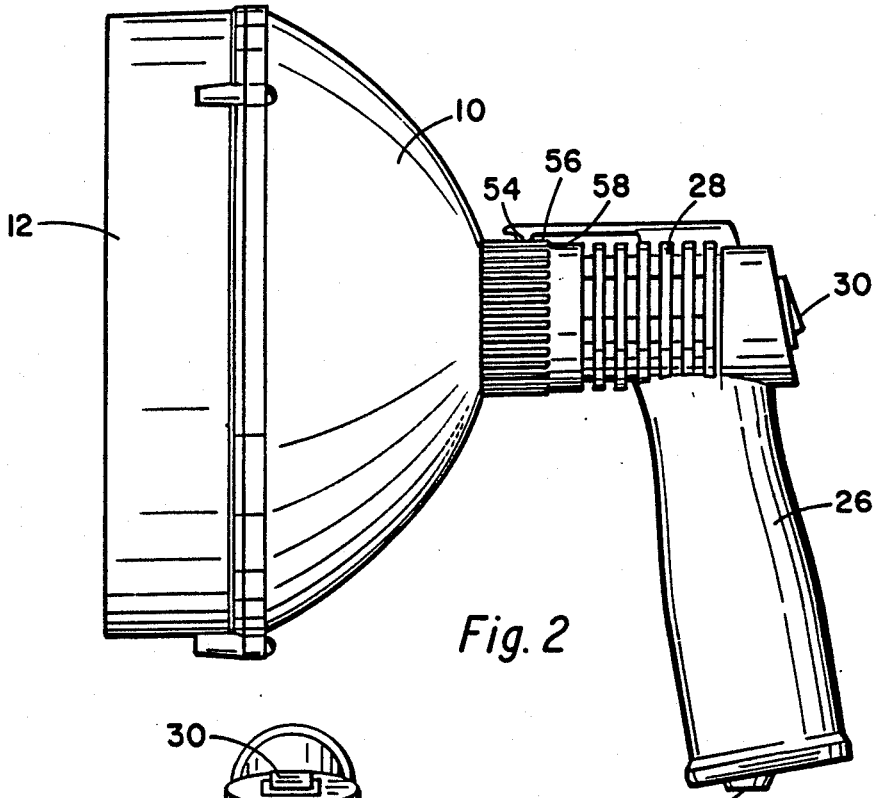
FIG. 2 is a plan side view of my Superlight light.
Figure 3:
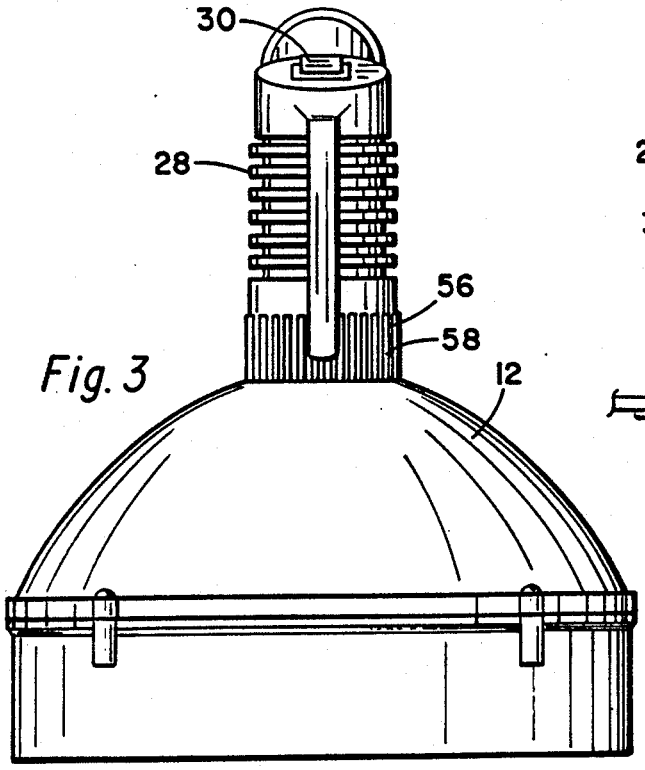
FIG. 3 is a top view of my plan Superlight light.

Attention is next directed to FIG. 5 which shows the Superlight spotlight mounted on the scope 62 of a rifle 64. A connector 31 is provided on the bottom of handle 26 as shown in FIG. 2. This is easily secured to the adjustable scope adaptor stud which is commonly available on telescope. This securing feature may be similar to that for securing a camera to a tripod.

Figure 4:
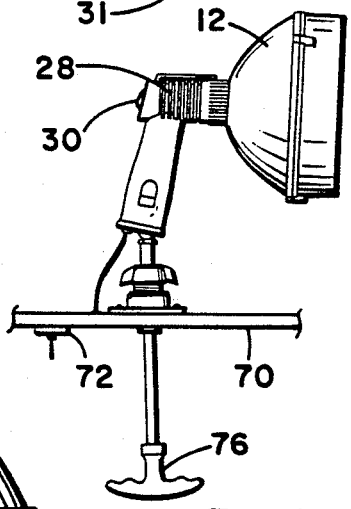
FIG. 4 shows my Superlight light mounted on a selected support.

FIG. 4 shows another way of mounting the Superlight spotlight on a support member 70. A switch 72 can be inserted into the circuit at any position along the support member and can be used to turn on or turn off the light so long as switch 30 is on the on position. Handle 76 can be used to adjust the position of the spotlight.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A light which comprises:

a handle having a first end and a second end;

a threaded cylinder having external threads thereon and mounted at said first end of said handle and having a globe holder held therein;

a globe in said globe holder;

a unitary reflector unit having a parabolic reflector and a hub made of unitary construction and with a longitudinal axis, said hub having internal threads mating with said external threads on said cylinder, the external surface of said hub having alternating ridges and valleys parallel to said longitudinal axis;

a leaf spring having a first end fixed to and supported by said handle and a second end having a locking bulge which is positioned to fit into any one of said valleys depending on the rotational position of said reflector with respect to said threaded cylinder, said leaf spring having sufficient resiliency such that the locking bulge can be lifted out of any of said valleys to permit rotation of said reflector with respect to said threaded cylinder;

there being no structure of the light external of said hub and said reflector other than said leaf spring whereby said reflector unit may be removed from said threaded cylinder without disassembly of any other part of the light.

2. A light as defined in claim 1 including a clip insert for fitting into said handle and having a spare globe compartment.

3. A light as defined in claim 1 including cooling fins supported by said handle adjacent said leaf spring and also including a seal between said hub and said cylindrical member.

4. A light as defined in claim 3 in which said handle is hollow to permit air circulation and in which said reflector includes a lens hood and lens.

* * * * *